US008421826B2

(12) United States Patent
Hsieh et al.

(10) Patent No.: US 8,421,826 B2
(45) Date of Patent: Apr. 16, 2013

(54) COLOR CALIBRATING METHOD, COLOR CALIBRATING CIRCUIT AND DISPLAY APPARATUS

(75) Inventors: Ming-Feng Hsieh, Tainan (TW); Jrong-Cheng Hong, Tainan (TW); Cheng-Tai Lee, Tainan (TW)

(73) Assignee: Chimei Innolux Corporation, Miao-Li County (TW)

( * ) Notice: Subject to any disclaimer, the term of this patent is extended or adjusted under 35 U.S.C. 154(b) by 822 days.

(21) Appl. No.: 12/358,314

(22) Filed: Jan. 23, 2009

(65) Prior Publication Data

US 2009/0195567 A1 Aug. 6, 2009

(30) Foreign Application Priority Data

Jan. 31, 2008 (TW) ..... 97103770 A

(51) Int. Cl.
*G09G 5/10* (2006.01)

(52) U.S. Cl.
USPC ..... 345/690; 345/589; 345/560; 345/63; 345/87; 345/88; 345/89; 345/204

(58) Field of Classification Search ..... 345/63, 345/87–89, 204, 690, 589–605
See application file for complete search history.

(56) References Cited

U.S. PATENT DOCUMENTS

| | | | | |
|---|---|---|---|---|
| 5,265,200 | A * | 11/1993 | Edgar | 345/589 |
| 5,638,117 | A * | 6/1997 | Engeldrum et al. | 348/179 |
| 6,269,565 | B1 * | 8/2001 | Inbar et al. | 40/361 |
| 7,432,897 | B2 * | 10/2008 | Nishitani et al. | 345/87 |
| 2002/0041287 | A1 * | 4/2002 | Engeldrum et al. | 345/589 |
| 2004/0036668 | A1 * | 2/2004 | Nakanishi | 345/88 |
| 2005/0225561 | A1 | 10/2005 | Higgins | |
| 2006/0221093 | A1 * | 10/2006 | Holub | 345/589 |

FOREIGN PATENT DOCUMENTS

| | | |
|---|---|---|
| TW | 200506794 | 2/2005 |
| TW | 200534228 | 10/2005 |
| TW | 200746798 | 12/2007 |

* cited by examiner

*Primary Examiner* — Alexander S Beck
*Assistant Examiner* — Jeffrey Steinberg
(74) *Attorney, Agent, or Firm* — Trop Pruner & Hu, P.C.

(57) ABSTRACT

A color calibrating method includes receiving a color signal wherein the color signal is associated with a set of minimum brightness voltages and a set of maximum brightness voltages, analyzing a distribution of the set of the minimum brightness voltages and a voltage distribution of the set of the maximum brightness voltages to obtain a first distribution curve and a second distribution curve, and adjusting a maximum value of the first distribution curve to a first target value and adjusting a maximum value of the second distribution curve to a second target value.

20 Claims, 5 Drawing Sheets

COLOR CALIBRATING METHOD, COLOR CALIBRATING CIRCUIT AND DISPLAY APPARATUS

CROSS-REFERENCE TO RELATED APPLICATIONS

This claims priority under 35 U.S.C. §119 of Taiwan Patent Application No. 97103770, filed Jan. 31, 2008, which is hereby incorporated by reference.

TECHNICAL FIELD

The invention relates to a color calibrating method, a color calibrating circuit and a display apparatus with enhanced image quality, and in particular, to adjusting the minimum and maximum gray-scale values.

BACKGROUND

In general, image signals received by most display devices are analog signals. An image is composed of different color signals (brightness gray-scale values) represented by different voltages. Referring to FIG. 2A, a color signal 1 includes a set of minimum brightness voltages 11 and a set of maximum brightness voltages 12. The color signal 1 causes liquid crystal molecules in a display device to twist and thus change the amount of light that can pass through a liquid crystal layer. The period of time during which the brightness rises from 10% to 90% is referred to as a rise time, and the period of time during which the brightness falls from 90% to 10% is referred to as a fall time.

When the color signal 1 is transmitted through a transmission cable, the impedance of the transmission cable may attenuate the signal, or interference in the transmission cable may distort the signal. The set of the minimum brightness voltages 11 and the set of the maximum brightness voltages 12 tend to have surge points caused by attenuation or interference. The presence of such surge points may cause the display device to misjudge the level of the image signal. For example, if the brightness gray-scale has a maximum value of 255, and a minimum value of 0, then attenuation or interference may cause the maximum value of an analog signal received by a display device to be equal to only 253 and not the maximum value of 255, while the minimum value of the analog signal may be equal to 1 and not the minimum value of 0. If a sum of the rise time and the fall time corresponding to transitioning between the gray-scale values 0 and 255 is 5 milliseconds (ms) and the sum of the rise time and the fall time corresponding to transitioning between the gray-scale values 1 and 253 is several tens of milliseconds, the response time is lengthened.

To achieve a full-color display, a display device applies red, green and blue filters. If the display device misjudges the level of the signals corresponding to the different colors, brightness differences may occur when the red, green and blue colors are outputted, which can cause the longitudinal ripple (mura) phenomenon.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF THE INVENTION

In accordance with some embodiments, a color calibrating mechanism in a display device is used to provide more accurate gray-scale values. Providing more accurate gray-scale values enhances image display quality by preventing the response time from being lengthened and preventing the longitudinal ripple phenomenon from occurring.

In accordance with some embodiments, the image display quality can be enhanced by analyzing and adjusting a color signal. The color signal received includes a set of minimum brightness voltages and a set of maximum brightness voltages. A voltage distribution of the set of the minimum brightness voltages can be analyzed and a voltage distribution of the set of the maximum brightness voltages can be analyzed to obtain a first distribution curve and a second distribution curve, respectively. A maximum value of the first distribution curve can be adjusted to a first target value and a maximum value of the second distribution curve can be adjusted to a second target value. Adjusting the maximum values in the distribution curves to the target values prevents the response time from being lengthened and the longitudinal ripple phenomenon from occurring.

Figure 1:
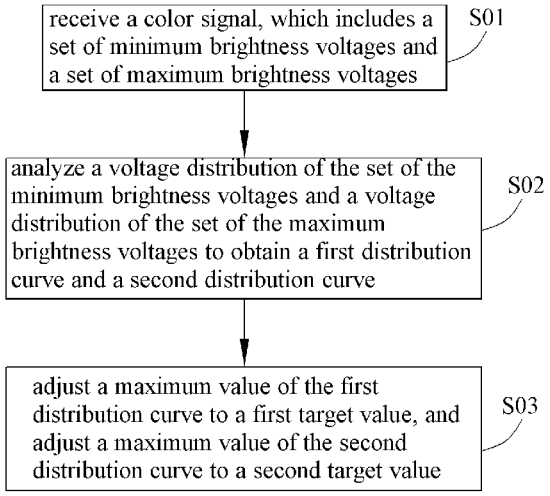
FIG. 1 is a flow chart showing a color calibrating method according to an embodiment of the invention.

Referring to FIG. 1, a flow chart shows a color calibrating method according to an embodiment that includes blocks S01 to S03. The color calibrating method may be applied to an analog/digital converter (A/D converter), a scaler, or a timing controller.

Figure 2A:
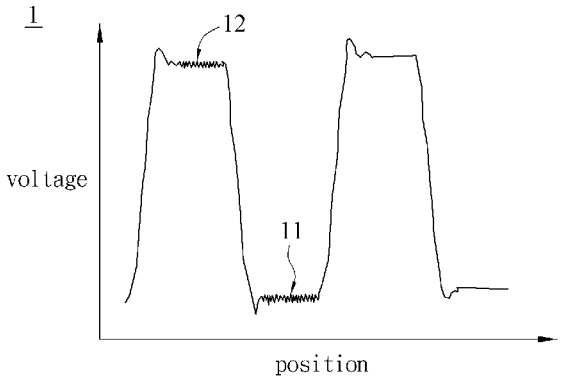
FIG. 2A shows voltage distributions of the set of minimum brightness voltages and the set of maximum brightness voltages.

Referring to FIGS. 1 and 2A, a color signal 1 is received in block S01. The color signal 1 can include a set of minimum brightness voltages 11 and a set of maximum brightness voltages 12, as depicted in FIG. 2A. The color signal 1 may be an analog color signal or a digital color signal. In addition, the color signal 1 may be a color signal in an RGB space, a color signal in a YCbCr space or a color signal in a YPbPr space.

Figure 2B:
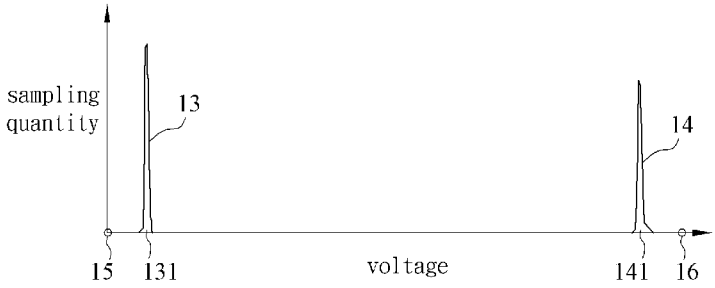
FIG. 2B is a schematic illustration showing target values, which are obtained by adjusting the maximum values of the distribution curves.

In block S02, a voltage distribution of the set of the minimum brightness voltages 11 and a voltage distribution of the set of the maximum brightness voltages 12 is analyzed by a numerical-statistical method. FIG. 2B shows a first distribution curve 13 and a second distribution curve 14, which can be obtained by the analysis in block S02. The graph of FIG. 2B plots voltage values with sampled quantities of the color signal at those voltage values. Thus, the first distribution curve shows the number of sampled voltages around voltage 131, and the second distribution curve 14 shows the number of sampled voltages around voltage 141.

In block S03, a minimum voltage value (131) corresponding to the first distribution curve 13 is adjusted to a first target value 15, and a maximum voltage value (141) corresponding to the second distribution curve 14 is adjusted to a second target value 16. The first target value 15 may be 0, for example. The offset between the minimum voltage value 131 and the first target value 15 is a first offset voltage value. The second target value 16 may be 255, for example. The offset between the maximum voltage value 141 and the second target value 16 is a second offset value. A gain value may be obtained according to the second offset voltage value between the maximum voltage value 141 and the second target value 16 according to the following different equations:

(gain value)=(second target value)/(maximum value of second distribution curve−second offset voltage value); or (gain value)=(second target value)/(maximum value of second distribution curve+second offset voltage value).

In other examples, the first target value 15 and second target value 16 can be values other than 0 and 255 depending on the minimum and maximum gray-scale values.

In an alternative embodiment, if the color signal 1 is a digital color signal, the gray-scale value distribution of the set of the minimum brightness voltages 11 and the gray-scale value distribution of the set of the maximum brightness voltages 12 may be obtained by way of analysis in the block S02.

Figure 3:
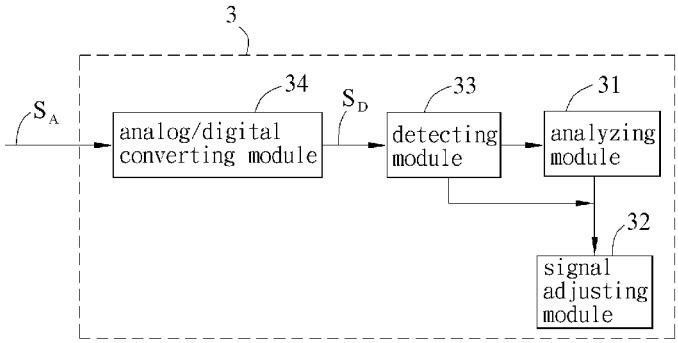
FIGS. 3 to 5 are schematic illustrations showing embodiments of a color calibrating circuit.

FIG. 3 shows a color calibrating circuit 3 according to an embodiment. The color calibrating circuit 3 includes an analyzing module 31, a signal adjusting module 32, a detecting module 33 and an analog/digital converting module 34. The color calibrating circuit 3 may be disposed in an analog/digital converter, a scaler, or a timing controller.

The color calibrating circuit 3 receives an analog color signal $S_A$. The signal $S_A$ includes a set of maximum brightness voltages and a set of minimum brightness voltages. The analog/digital converting module 34 receives the analog color signal $S_A$ and converts the analog color signal $S_A$ into a digital color signal $S_D$, which is provided to the detecting module 33. The detecting module 33 can be electrically connected to the analyzing module 31 and the signal adjusting module 32. The detecting module 33 is for determining whether the analog color signal $S_A$ is to be output to the analyzing module 31 or the signal adjusting module 32 according to an external signal. In alternative embodiments, additional circuitry may be connected between the analyzing module 31, the signal adjusting module 32, and the detecting module 33.

The analyzing module 31 analyzes the voltage distribution of the set of the maximum brightness voltages and the voltage distribution of the set of the minimum brightness voltages to obtain a first distribution curve and a second distribution curve, such as curves 13 and 14 depicted in FIG. 2B.

The signal adjusting module 32 adjusts a minimum value corresponding to the first distribution curve to a first target value and adjusts a maximum value corresponding to the second distribution curve to a second target value.

Although reference has been made above to analyzing the voltage distribution of maximum brightness voltages and minimum brightness voltages, note that the analysis can be of the distribution of maximum gray-scale values and minimum gray-scale values for digital color signal $S_D$ output by the analog/digital converting module 34. The digital color signal $S_D$ may have a first distribution curve and the second distribution curve that corresponds to the voltage distribution curves of the analog color signal. While the first distribution curve and the second distribution curve of the analog color signal $S_A$ are voltage value distribution curves, the first distribution curve and the second distribution curve of the digital color signal $S_D$ are gray-scale value distribution curves that correspond to the voltage distribution curves.

Figure 4:
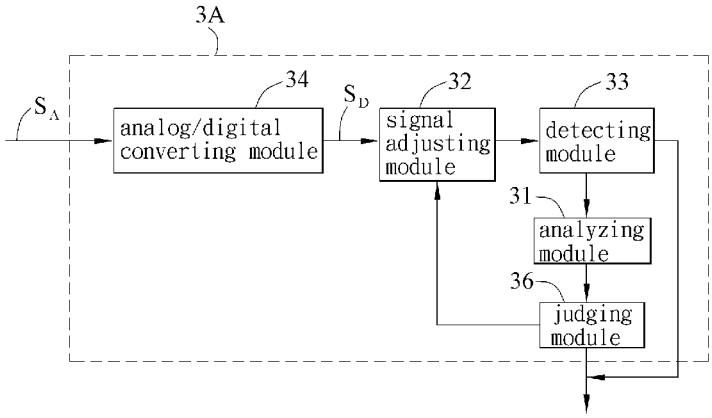

In alternative embodiments the order in which the analyzing and adjusting of the color signal occur may be reversed. FIG. 4 shows an embodiment of a color calibrating circuit 3A where the signal adjusting module 32 receives the color signal before the color signal is received by the analyzing module 31. The digital color signal $S_D$ is adjusted by the signal adjusting module 32 and then transmitted to a post-processing stage. The post-processing stage includes the detecting module 33, the analyzing module 31 and the judging module 36.

The judging module 36 can determine if the minimum value corresponding to the first distribution curve of the digital color signal $S_D$ is approximately equal to the first target value and if the maximum value corresponding to the second distribution curve is approximately equal to the second target value. If the judging module determines that the minimum and maximum values are approximately equal to the target values, then the digital color signal $S_D$ is output. If the judging module determines that the minimum and maximum values are not approximately equal to the target values, the digital color signal $S_D$ is transmitted to the signal adjusting module 32 for adjustment.

Figure 5:
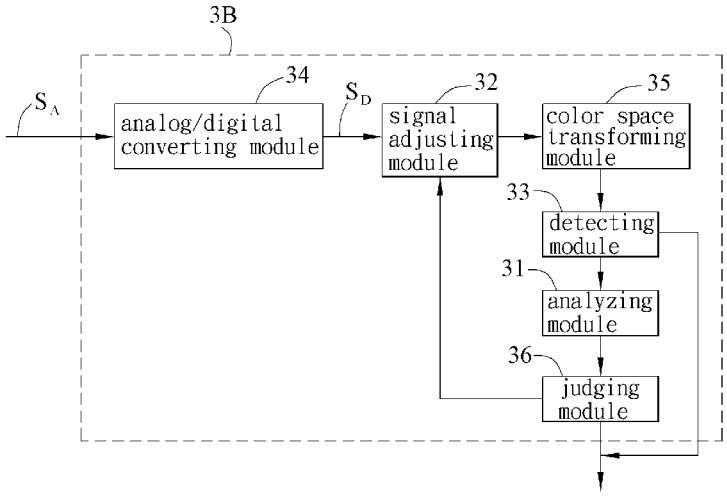

FIGS. 5 shows another embodiment of the color calibrating circuit 3B which may include a color space transforming module 35, in addition to the other modules referred to above in FIG. 4.

The color space transforming module 35 can receive signals output from the signal adjusting module 32 and transform a color signal in the RGB space into a color signal in the YCbCr space or a color signal in the YPbPr space. In some embodiments, an analog color signal $S_A$ received by the analyzing module 31 is a color signal in the RGB space.

Figure 6:
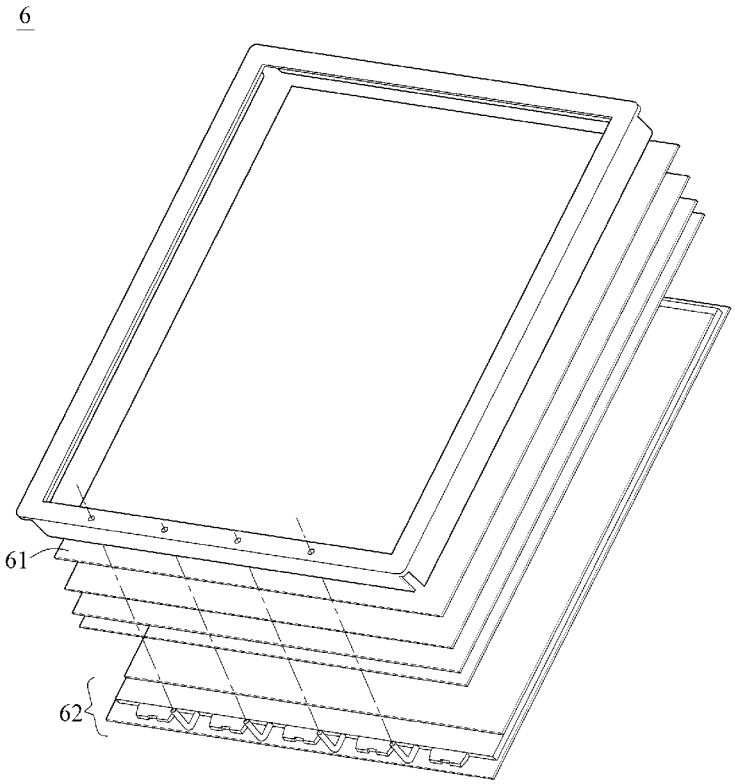
FIG. 6 is a schematic illustration showing a display apparatus.

FIG. 6 is a schematic illustration showing a display device 6. The display device 6 may be a liquid crystal display (LCD) device having a backlight module 61, a display panel 62 and a color calibrating circuit (not shown). The backlight module 61 may be, for example, a lamp, a light-emitting diode (LED) or an organic light emitting diode (OLED). Some examples of a lamp include a cold cathode fluorescent lamp (CCFL) or a hot cathode fluorescent lamp (HCFL).

In some embodiments the color calibrating circuit of the display device 6 may be disposed in an analog/digital converting circuit board (A/D board). Alternatively, some of the modules of the color calibrating circuit including the analyzing module and the judging module may be disposed in the scale or the timing controller of the LCD device.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A color calibrating method, comprising:

receiving a color signal associated with a set of minimum brightness voltages and a set of maximum brightness voltages;

analyzing a distribution of the set of the minimum brightness voltages and a distribution of the set of the maximum brightness voltages to obtain a first distribution curve and a second distribution curve, respectively, wherein the first distribution curve corresponds to sampled quantities of the color signal at the set of the minimum brightness voltages, and the second distribution curve corresponds to sampled quantities of the color signal at the set of the maximum brightness voltages; and adjusting a minimum value corresponding to a maximum sampled quantity of the first distribution curve to a first target value and adjusting a maximum value corresponding to a maximum sampled quantity of the second distribution curve to a second target value.

2. The color calibrating method according to claim 1, further comprising converting an analog color signal to a digital color signal.

3. The color calibrating method according to claim 2, wherein the first distribution curve and the second distribution curve are voltage value distribution curves if the color signal is the analog color signal.

4. The color calibrating method according to claim 2, wherein the first distribution curve and the second distribution curve are gray-scale value distribution curves if the color signal is the digital color signal, wherein analyzing the distribution comprises analyzing a set of maximum gray scale values and a set of minimum gray scale values.

5. The color calibrating method according to claim 1, wherein the first distribution curve and the second distribution curve are obtained by a statistical method.

6. The color calibrating method according to claim 1, further comprising transforming the color signal in an RGB space to a YCbCr space or a YPbPr space.

7. The color calibrating method according to claim 1 being applied by an analog/digital converter, a scaler, or a timing controller.

8. A color calibrating circuit, comprising:

an analyzing module to receive a color signal, where the color signal is associated with a set of maximum brightness voltages and a set of minimum brightness voltages, and to analyze a distribution of the set of the maximum brightness voltages and a voltage distribution of the set of the minimum brightness voltages to obtain a first distribution curve and a second distribution curve, respectively, wherein the first distribution curve corresponds to sampled quantities of the color signal at the set of the minimum brightness voltages, and the second distribution curve corresponds to sampled quantities of the color signal at the set of the maximum brightness voltages; and a signal adjusting module to adjust a minimum value corresponding to a maximum sampled quantity of the first distribution curve to a first target value, and to adjust a maximum value corresponding to a maximum sampled quantity of the second distribution curve to a second target value.

9. The color calibrating circuit according to claim 8, further comprising:

a detecting module to receive an external signal and to determine whether or not to provide the color signal to the analyzing module.

10. The color calibrating circuit according to claim 9, further comprising:

an analog/digital converting module to receive an analog color signal, to convert the color signal into a digital color signal, and to output the digital color signal to the detecting module or the signal adjusting module.

11. The color calibrating circuit according to claim 9, further comprising:

a color space transforming module to transform the color signal in a RGB space into a color signal in a YCbCr space or a YPbPr space.

12. The color calibrating circuit according to claim 8, further comprising:

a judging module to determine whether the minimum value corresponding to the first distribution curve of the color signal is at the first target value and the maximum value corresponding to the second distribution curve is at the second target value and to transmit the color signal back to the signal adjusting module for adjustment if the minimum value corresponding to the first distribution curve is not at the first target value and the maximum value corresponding to the second distribution curve is not at the second target value.

13. The color calibrating circuit according to claim 8 being disposed in an analog/digital converter, a scaler, or a timing controller.

14. A display device, comprising:

a backlight module;

a display panel disposed adjacent to the backlight module; and a color calibrating circuit, comprising:

an analyzing module to receive a color signal, where the color signal is associated with a set of maximum brightness voltages and a set of minimum brightness voltages, and to analyze a distribution of the set of the maximum brightness voltages and a voltage distribution of the set of the minimum brightness voltages to obtain a first distribution curve and a second distribution curve, respectively, wherein the first distribution curve corresponds to sampled quantities of the color signal at the set of the minimum brightness voltages, and the second distribution curve corresponds to sampled quantities of the color signal at the set of the maximum brightness voltages, and a signal adjusting module to receive the first distribution curve and the second distribution curve from the analyzing module and to adjust a minimum value corresponding to a maximum sampled quantity of the first distribution curve to a first target value and adjusting a maximum value corresponding to a maximum sampled quantity of the second distribution curve to a second target value.

15. The display device according to claim 14, wherein the backlight module comprises a lamp, a light-emitting diode (LED) or an organic light emitting diode.

16. The display device according to claim 15, wherein the lamp is a cold cathode fluorescent lamp (CCFL) or a hot cathode fluorescent lamp (HCFL).

17. The display device according to claim 14, wherein the color calibrating circuit further comprises:

a detecting module to receive an external signal and to determine whether the color signal is output to the analyzing module.

18. The display device according to claim 17, wherein the color calibrating circuit further comprises:

an analog/digital converting module to receive an analog color signal, to convert the color signal into a digital color signal, and then to output the digital color signal to the detecting module or the signal adjusting module.

19. The display device according to claim 17, wherein the color calibrating circuit further comprises:

a color space transforming module to transform the color signal in a RGB space into a color signal in a YCbCr space or a YPbPr space.

20. The display device according to claim 14, wherein the color calibrating circuit further comprises:

a judging module to determine whether the minimum value corresponding to the first distribution curve of the color signal is at the first target value and the maximum value corresponding to the second distribution curve is at the second target value and to transmit the color signal back to the signal adjusting module for adjustment if the minimum value corresponding to the first distribution curve is not at the first target value and the maximum value corresponding to the second distribution curve is not at the second target value.

* * * * *